US006094558A

United States Patent [19]

Shimizu et al.

[11] Patent Number: 6,094,558

[45] Date of Patent: Jul. 25, 2000

[54] TRANSFER BELT AND ELECTROPHOTOGRAPHIC APPARATUS

[75] Inventors: Ryuuichi Shimizu; Takashi Nishimura; Kenichi Kugai; Masato Miwa; Masafumi Shimizu, all of Ibaraki, Japan

[73] Assignee: Hitachi Koki Co., Ltd., Tokyo, Japan

[21] Appl. No.: 09/203,176

[22] Filed: Nov. 30, 1998

[30] Foreign Application Priority Data

Nov. 28, 1997 [JP] Japan ..... 9-327812

[51] Int. Cl.[7] ..... G03G 15/16

[52] U.S. Cl. ..... 399/303; 399/312; 430/48; 430/126

[58] Field of Search ..... 399/303, 308, 399/312, 316; 430/48, 126

[56] References Cited

U.S. PATENT DOCUMENTS

| | | | |
|---|---|---|---|
| 5,148,224 | 9/1992 | Yamada et al. | 399/312 |
| 5,335,052 | 8/1994 | Sato et al. | 399/312 |
| 5,340,679 | 8/1994 | Badesha et al. | 430/126 |
| 5,390,012 | 2/1995 | Miyashiro et al. | 399/303 |
| 5,633,702 | 5/1997 | Hayashi et al. | 399/316 |
| 5,715,510 | 2/1998 | Kusaba et al. | 399/308 |
| 5,745,831 | 4/1998 | Nakazawa et al. | 399/308 |
| 5,903,802 | 5/1999 | Watanabe et al. | 399/303 X |

FOREIGN PATENT DOCUMENTS 9-281813 10/1997 Japan .

*Primary Examiner*—William J. Royer
*Attorney, Agent, or Firm*—Sughrue, Mion, Zinn, Macpeak & Seas, PLLC

[57] ABSTRACT

A transfer belt for use in an electrophotographic apparatus for transporting an image support onto which a toner image formed on a surface of a photoconductor containing a photoconductive layer is transferred, and the transfer belt includes a surface layer formed from a coating liquid containing: a solvent; at least one kind of inorganic or organic fine particles dispersible in the solvent; and at least one kind of organic compound dissolved in the solvent. Also disclosed is an electrophotographic apparatus using the transfer belt.

9 Claims, 1 Drawing Sheet

TRANSFER BELT AND ELECTROPHOTOGRAPHIC APPARATUS

FIELD OF THE INVENTION

The present invention relates to a transfer belt adapted to an electrostatic recording apparatus, particularly, to an electrophotographic apparatus using electrophotography, and also relates to an electrophotographic apparatus using the transfer belt.

BACKGROUND OF THE INVENTION

As for electrophotography, various methods are proposed, as disclosed in JP-B-42-23910 (The term "JP-B" used herein means an "examined Japanese patent publication"), JP-B-43-24748, and US Patent No. 2,297,691. However, generally used is such a method that an electrostatic latent image is formed on the surface of a photoconductor made of photoconductive material, the latent image is developed with a toner, and then the toner is transferred onto an image support such as paper or the like.

On the other hand, as for a method of transferring the toner image formed on the photoconductor onto the image support, there is a method using a transfer belt. According to this method, the image support is transported by the transfer belt while being electrostatically attracted thereto at the step of transferring the toner image formed on the photoconductor directly onto the image support so as to form an image. It is therefore possible to eliminate a support pressing mechanism which is provided for the purpose of preventing the image support from being transported meanderingly, or the like. Accordingly, there is an advantage that a printing prohibition area is considerably reduced, so that an image can be formed over the whole are of the image support.

In the above-mentioned electrophotographic system using a transfer belt, various properties are required for transferring a toner image uniformly and efficiently from a photoconductor onto an image support. For example, an elastic layer is provided on the surface of the transfer belt that is located at the side of the image support opposite to the photoconductor side, and such a mechanism that absorbs stress from the outside to some extent is provided. Then, the surface of the photoconductor is prevented from being damaged when a foreign matter such as a carrier is inserted in a nip portion between the photoconductor and the image support. It is effective in prolonging the life of the photoconductor. This method has another advantage that the nip can be ensured stably at a transfer point between the photoconductor and the image support. In addition, the transfer belt is required to have suitable electric properties (resistance, electrification, electric current flowing upon transferring, etc.) in which a toner image can be transferred onto the image support uniformly while preventing disorder of the image, or to have mechanical properties in view of the life of the transfer belt itself. Therefore, the transfer belt itself is constituted by numbers of layers so that some of the layers are made to have electrical conductivity, and some of the layers are improved in mechanical strength to thereby adjust the balance of the respective properties.

However, there was a problem that a conventional transfer belt lacked stability in transporting the image support even if elasticity was given to the transfer belt, or even if electric conductivity and mechanical properties thereof were adjusted as mentioned in the above conventional techniques.

That is, when a new transfer belt was attached to form an image, a phenomenon called "drum wrap" in which an image support wrapped on a photoconductor sometimes occurred at an initial stage. Further, not only at an initial stage, but also in any other times, there occurred a problem that the image support meandered, or the reliability of an image forming apparatus itself was lowered. In addition, when these problems were intended to be improved, toner scattering or image dislocation such as transfer failure was caused at the time of transfer. This problem has a trade-off relation with respect to the above-mentioned problems.

Further, there was another problem that the characteristics of paper used by users were largely different depending on the users so that it is very difficult to ensure the stable transport of the paper and the image quality to be obtained.

Particularly recently, an electrophotographic apparatus is required so as to have features such as high speed, high image quality, power saving, and low cost, and severely required so as to have properties of stability in transporting an image support, maintenance-free of the apparatus, and stability in image quality.

SUMMARY OF THE INVENTION

It is therefore an object of the present invention to provide an long-life transfer belt in which not only a problem of the trade-off relation between the stability in transporting an image support and stability of image quality in the electrophotographic apparatus is mitigated, but also it can be effectively applied to a maintenance-free type apparatus and provides stable performance of transporting the image support for a long time.

Another object of the present invention is to provide a highly reliable electrophotographic apparatus using the transfer belt.

Other objects and effects of the present invention will become apparent from the following description.

The present inventors investigated a relationship between the surface state of a transfer belt in the transfer portion and the transport performance of an image support, and a relationship among the surface state and permittivity of the transfer belt, a state of an image at the time of transfer, and drum wrap, in order to stabilize the transport performance of the image support, prevent the image support from causing drum wrap, and improve the trade-off relationship between improvement of image disorder at the time of transfer and stabilization of a transfer portion as a whole so as to realize the both. As a result, it was found that the surface state of the transfer belt largely influenced on the transport performance of the image support and the drum wrap phenomenon of the image support. It was also found that these improvements largely influenced on both density and quality of a transferred image. Improvement of the transport performance of the image support and the drum wrap of the image support causes toner scattering or blank area due to poor transfer, so that the image becomes defective and the reliability of.the image is considerably reduced. It is therefore inevitable to solve the aforementioned trade-off relationship problem.

The above-described objects of the present invention have been achieved by the following transfer belts.

(1) A transfer belt for use in an electrophotographic apparatus for transporting an image support onto which a toner image formed on the surface of a photoconductor comprising a photoconductive layer is transferred, which transfer belt comprises a base layer having thereon a surface layer formed from a coating liquid comprising:

a solvent;

at least one kind of inorganic or organic fine particles dispersible in the solvent; and at least one kind of organic compound soluble in the solvent.

(2) The transfer belt according to the above (1), wherein said fine particles are electrically insulating material.

(3) The transfer belt according to the above (1), wherein said inorganic fine particles are silica particles, and said organic fine particles dispersible in the solvent are particles of a silicone material.

(4) The transfer belt according to any one of the above (1), wherein said solvent is an organic solvent.

(5) The transfer belt according to any one of the above (1) to (4), wherein said base layer is an elastic layer, said elastic layer comprising a plurality of layers.

(6) The transfer belt according to any one of the above (1) to (4), wherein said base layer is a fluorine-containing elastic layer.

(7) The transfer belt according to any one of the above (3) to (6), wherein said silica fine particles have the same electrification polarity as a voltage applied to said transfer belt.

(8) The transfer belt of an electrophotographic apparatus according to any one of the above (1) to (7), wherein said organic compound soluble in the solvent is a silicone material.

The present invention also relates to an electrophotographic apparatus comprising:

a photoconductor comprising a photoconductive layer onto which a toner image is formed; and a transfer belt for transporting an image support onto which said toner image formed on the photoconductor is transferred, wherein said transfer belt comprises a surface layer formed from a coating liquid comprising:

a solvent;

at least one kind of inorganic or organic fine particles dispersible in the solvent; and at least one kind of organic compound soluble in the solvent.

That is, the inorganic or organic fine particles are fixed to the surface of the transfer belt by the organic. materials soluble in the solvent, so that a suitable space is provided between the surface of the transfer belt and the image support. In addition, the permittivity of the transfer belt is reduced suitably so as to improve the absorption force of the paper. In such a manner, wrapping of the image support on the photoconductor, that is, a drum wrap phenomenon is suppressed, and image disorder at the time of transfer is also suppressed. Further, fine roughness which provides superior releasability is formed on the surface of the transfer belt, so that not only it is possible to prevent separation discharge when the paper is separated from the transfer belt, but also it is possible to perform the separation smoothly.

DETAILED DESCRIPTION OF THE PREFERRED EMBODIMENTS

Embodiments of the present invention are described below with reference to the drawings.

Figure 1:
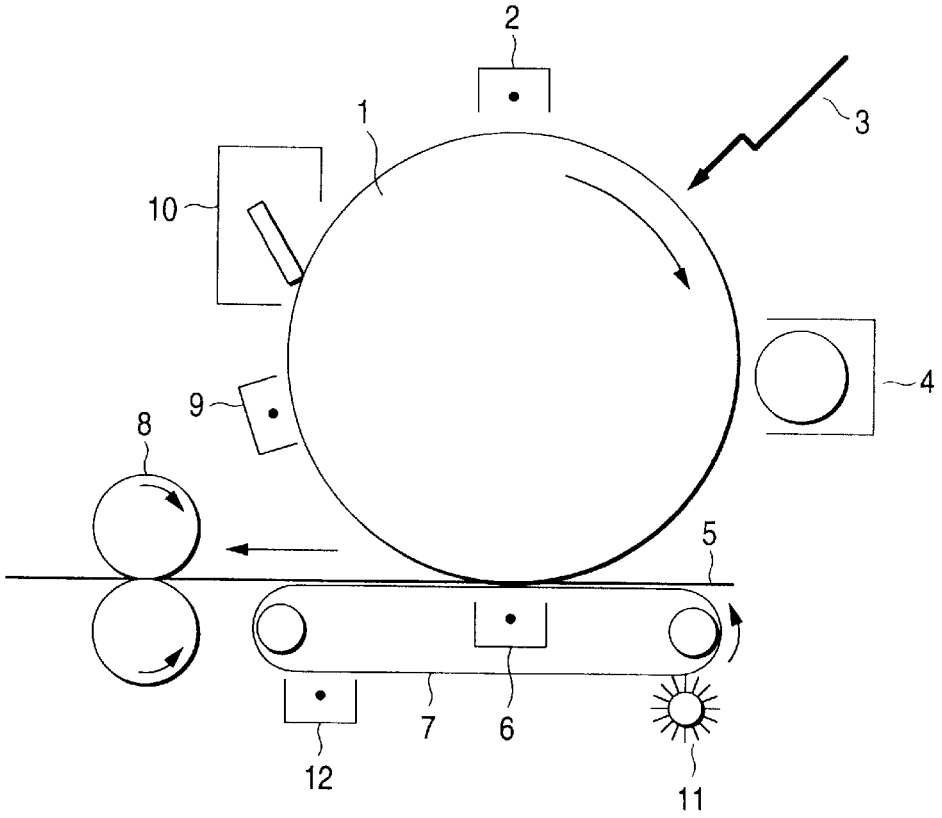
FIG. 1 is a side view showing a schematic configuration of an embodiment of the electrophotographic apparatus according to the present invention.

FIG. 1 is a view showing a configuration of an embodiment of the electrophotographic apparatus according to the present invention.

In an image forming portion of this electrophotographic apparatus, a charger 2, laser light 3 acting as exposure means, a developing device 4, a transferring device 6, a transfer belt 7, an static eliminator 9, and a cleaner 10 are disposed around a photosensitive drum 1 in the order of an electrophotographic process. The photosensitive drum 1 comprises an organic photoconductor (OPC) having a charge generating layer and a charge transporting layer which are provided on an aluminum base pipe. The charge generating layer comprises a charge generating material such as titanyl phthalocyanine and a binding agent such as acrylic resin. The charge transporting layer comprises a charge transporting material such as hydrazone compound and a binding agent such as polycarbonate. A fixing device 8 for fixing a toner image on paper 5 is provided on the downstream side of the image forming portion.

Next, the electrophotographic process is described below. After the photosensitive drum 1 is charged uniformly by the charger 2, a latent image is formed by the laser light 3. Then, the latent image is developed with toner by the developing device 4. The developed toner image is transferred onto the paper 5 by the transferring device 6 inside the transfer belt 7, and transported by the transfer belt 7. Subsequently, the toner image is melted and fixed onto the paper 5 by the fixing device 8. A residual charge of the transfer belt 7 is eliminated by a belt static eliminator 12. Toner adhering to the belt surface is cleaned by a belt cleaner 11. The belt cleaner 11 may be eliminated. A charge on the surface of the photosensitive drum 1 is eliminated by the transfer belt 7 and the static eliminator 9. The residual toner is removed and recovered by the cleaner 10. Then, a series of process is completed.

Next, the transfer belt for use in this embodiment is described below.

Figure 2:
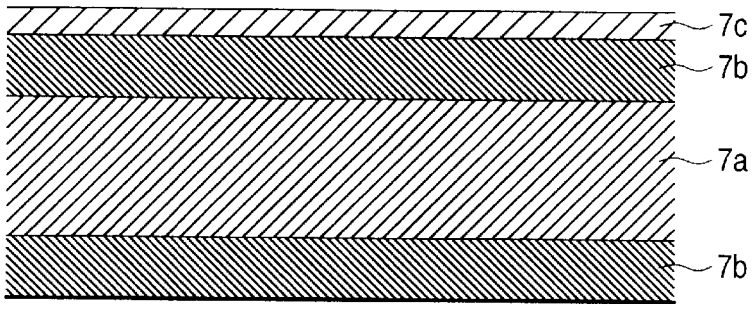
FIG. 2 is a sectional view of an embodiment of the transfer belt according to the present invention.

FIG. 2 is a schematic sectional view of the transfer belt.

The transfer belt 7 comprises a base layer which may comprise: a polyurethane rubber (elastic layer) 7*a* having flexibility and elasticity; and reinforcing/releasing layers 7*b*, which are disposed on both sides of the elastic layer 7*a* and formed for preventing the polyurethane rubber from deteriorating due to ozone, reinforcing the mechanical strength of the belt, and improving the releasability of the surface, as shown in FIG. 2. In this embodiment, a fluorine-containing rubber in which a fluororesin is dispersed is used as the reinforcing/releasing layers 7*b*. Further, a surface layer 7*c* according to the present invention is provided on the upper reinforcing/releasing layer 7*b* by spray coating. In such a manner, the transfer belt 7 has a four-layer structure.

Similar effects can be obtained even if the transfer belt 7 is prepared by providing a surface layer according to the present invention onto a base layer consisting of the elastic layer 7*a*. Furthermore, chloroprene rubbers, acrylic rubbers, silicone rubbers, nitrile rubbers, hydrin rubbers, fluoro rubbers, etc. can be used as the elastic layer 7*a* so of a single layer or a combination of two or more different layers depending on the intended purpose.

In addition, commonly used materials having flexibility such as fluorocarbon materials, semiconductive plastics, polyethylene terephthalate, etc. may be used as the material of a layer 7*b* formed on either or both of the front and back surfaces of the elastic layer 7*a* for preventing the elastic layer 7*a* from deterioration by ozone, reinforcing the mechanical strength of the belt, and improving the releasability of the surface or adjusting the resistant value, and so on.

The method of coating the coating liquid in the present invention is not limited to spray coating. Bar-coater coating or the like may be used so long as coating liquid containing fine particles can be applied uniformly onto the surface of the base layer of the transfer belt. In preparation of the coating liquid used for coating, a well-known dispersant may be used as a dispersing agent for the fine particles as needed.

In addition, when the surface of the base layer constituting the transfer belt is made of an organic material or constituted by an elastic layer of the organic material, not only is it preferable to perform coating by using an organic solvent as a solvent to be used for coating to thereby form fine roughness having superior releasability on the transfer belt surface, but also it is more preferable to swell the base layer surface slightly at the time of coating, and impregnate the surface with resin or oil material as the organic material soluble in the solvent to thereby improve the adhesion force between the transfer belt surface and the particulate material. Thus, the stability can be kept for a longer time.

That is, it is more preferable that the inorganic or organic fine particles are fixed to the transfer belt surface by the resin or oil material soluble in the solvent, so that not only a suitable space is provided between the transfer belt surface and the image support but also the permittivity of the transfer belt is reduced.suitably to thereby improve the attraction force of paper.

To obtain the above described suitable space and excellent characteristics, the total coating amount (after dried) of the fine particles and the organic compound soluble in the solvent is preferably about from 0.3 g to 20 g per 1000 $cm^2$, though the amount depends on the particle size of the fine particles and the adhesive property, releasability, etc. of the organic compound.

The weight ratio of the fine particles dispersible in the solvent and the organic compound soluble in the solvent is preferably such that the content of the fine particles and that of the organic compound are from 60 to 97% and 3 to 40%, respectively, based on the total weight thereof.

The amount of the solvent used can be appropriately selected as long as the solvent does not hinder dispersion of the fine particles and can dissolve therein the organic compound soluble to the solvent,enough.

The fine particles for use in the present invention are preferably those comprising a base material that is less apt to physically adhere to paper, such as silica ($SiO_2$), silicone based resins, fluorine-containing resins. Particularly, it is preferred to use fine particles having a large specific surface area or fine particles having imparted thereto an electrification polarity opposite to that of a toner by chemical surface treatment.

The organic compound soluble in the solvent for use in the present invention is preferably a compound that does not hinder dispersion of the fine particles and has an adhesive property with respect to the coated-surface and the fine particles. Examples of such a preferred organic compound include silicone oil, silicone based resins, acrylic resins, polyester resins and fluorine-containing resins. The organic compound soluble in the solvent particularly preferably has a releasability from paper as well.

The solvent for use in the present invention may be an aqueous solvent or an organic solvent. Examples thereof include alcohols such as ethyl alcohol and isopropyl alcohol; aromatic solvents such as toluene and xylene; hydrocarbon solvents such as hexane and cyclohexane; ketones such as acetone and 2-butanone; ethers such as dimethyl ether and diethyl ether; aqueous solvents such as water and water containing dispersing agent and emulsifying agent. These solvents may be used alone or as a mixture of two or more thereof.

As for the toner for use in the present invention, available are those in which well-known toner resin, colorant, antistat, assistant, etc. are blended, and made into toner by a well-known method, or those in which an external additive is further blended with these toner materials in order to obtain desired properties.

As for the photoconductor, a well-known photoconductor may be used regardless of that it is inorganic one or organic one.

The present invention is not limited to a transfer belt apparatus of a type using corona discharge, but may be applicable to, for example, an apparatus of a direct application system. In addition, the present invention is applicable to a transfer belt having only either one of functions of transfer and transport, as well as a transfer belt having both the functions of transfer and transport.

Further, the present invention is applicable to a transfer belt in an electrostatic recording apparatus using a printing system other than an electrophotographic system, for example, an ion-flow system or a direct imaging system.

The present invention will be described in greater detail with reference to the following Examples, but the invention should not be construed as being limited thereto.

EXAMPLE 1

After agitating and mixing predetermined amounts of DAI-L Latex GLS-213 (A) liquid (made by Daikin Kogyo Co., Ltd.) and DAI-L Latex GLS-213 (B) liquid (made by Daikin Kogyo Co., Ltd.), both surfaces of a sheet of polyurethane rubber (2 mm thick) were coated with the mixture by means of a spray gun, and baked at 170° C. for one hour after natural seasoning, so that a transfer belt having a surface layer about 20 micron thick was obtained.

Next, 4 parts by weight of silica (inorganic material, Aerosil RY-200H, made by Nippon Aerosil Co., Ltd.), and 0.6 parts by weight of silicone oil (Silicone Oil KF54, made by Shin-etsu Chemical Industry Co., Ltd.) were dispersed and dissolved in 85.4 parts by weight of a solvent (toluene, made by Wako Pure Chemical Industries, Ltd.), and subjected to ultrasonic dispersion for two hours, so as to prepare a coating liquid for coating the transfer belt surface. The thus prepared coating liquid was applied to the transfer belt surface by means of a spray gun at the rate of 15 g/1,000 $cm^2$, and dried at 110° C. for one hour after natural seasoning, so that an aimed transfer belt was obtained.

Evaluation was made on the state of occurrence of drum wrap in paper, the transport performance of the paper, and the quality of the obtained images by using this transfer belt in an electrophotographic.apparatus, as shown in FIG. 1, which was herein a laser printer for cut paper having a printing speed of 60 pages per minute, by way of example.

Here, paper (55 kg ream weight paper) which was apt to cause drum wrap was used in addition to HINIP-HS Paper (55 kg ream weight paper made by Kobayashi Kiroku-shi Co., Ltd.) used for the printer. The "paper which was apt to cause drum wrap" means paper prepared by cutting 5-piled and 8-piled sheets of paper by means of a cutter so as to increase burrs in the cut surfaces.

In the evaluation, these sheets of paper were transported so that the burr head portions of the paper abut against the surface of the transfer drum, and the sheets of paper were set to blank printing so as to cause drum wrap easily.

The above-mentioned three kinds of paper were replaced by new ones respectively, and evaluation was repeated 5 times. As a result, no drum wrap occurred. In addition, no meandering appeared in the paper, and the paper transport performance was superior. Further, images were outputted, and the quality of the obtained images was evaluated. As a result, no toner scattering or no content missing phenomenon in the images was observed, and superior images were obtained.

A test of continuous printing of 100 thousand pages was performed by using the above-mentioned transfer belt. As a result, no drum wrap, no paper meandering, and so on, were produced, and superior transport performance of paper was exhibited. Further, images superior in quality and having no problem were obtained during the continuous printing.

EXAMPLES 2 TO 7 AND COMPARATIVE EXAMPLES 1 to 3

Coating liquid to be applied onto a transfer belt was prepared by compositions as shown in Table 1, applied by means of a spray gun by coating liquid amounts shown in Table 1. After the coating was dried, evaluation was performed in the same manner as in Example 1.

TABLE 1

| | coating liquid composition | | | | | | | |
|---|---|---|---|---|---|---|---|---|
| | fine particles | | | organic compound | | solvent | | coating |
| Ex. Nos. | name | particle size | loads (parts by weight) | name | loads (parts by weight) | name | loads (parts by weight) | liquid amount (g/1,000 $cm^2$) |
| 1 | Aerosil RY-200H *A | about 12 nm | 4 | silicone oil KF54 *D | 0.6 | toluene *E | 85.4 | about 15 |
| 2 | Aerosil RY-200H *A | about 12 nm | 4 | silicone oil KF968 *D | 0.6 | toluene *E | 85.4 | about 25 |
| 3 | Nipsil E220A *B | 1.5 μm | 4.5 | silicone varnish KF271 *D | 1.2 | MEK *E | 84.3 | about 20 |
| 4 | Tospearl 240 *C | 4.0 μm | 4.5 | silicone oil KF54 *D | 0.6 | MEK *E | 79.9 | about 15 |
| 5 | Nipsil 2000B *B<br>Aerosil RY-200H *A | about 7 μm<br>about 12 nm | 4<br>4 | silicone oil KF54 *D | 1.2 | toluene | 85.4 | about 12 |
| 6 | Aerosil RY-200H *A | about 12 nm | 4.5 | silicone oil KF968 *D<br>silicone resin KR216 *D | 0.4<br>0.6 | toluene *E | 84.5 | about 25 |
| 7 | Tospearl 240 *C<br>Aerosil RY-200H *A | 6.0 μm<br>about 12 nm | 2<br>3 | silicone oll KF54 *D | 0.8 | toluene *E | 84.2 | about 20 |
| Comp. 1 | — | — | — | not-treated product | — | — | — | — |
| Comp. 2 | Aerosil RY-200H *A | about 12 nm | 4 | — | — | toluene *E | 86 | about 20 |
| Comp. 3 | — | — | — | silicone oll KF54 *D | 0.6 | MEK *E | 89.4 | about 18 |

*A: Nippon Aerosil Co., Ltd.
*B: Nippon Silica Industrial Co., Ltd.
*C: Toshiba Silicone Co., Ltd.
*D: Shin-etsu Chemical Industry Co., Ltd.
*E: Wako Pure Chemical Industries, Ltd.

Here, Aerosil and Nipsil in the form of fine particles are silica which are inorganic materials. Tospearl is an organic compound of a silicone. Silicone oil which is an oil material, silicone varnish and silicone resin which are resin were used as the organic material soluble in the solvent. Toluene and MEK (methyl ethyl ketone) are solvents. For comparison, there were provided Comparative Example 1 which is a not-treated product, Comparative Example 2 which has no solution of organic material, and Comparative Example 3 which has no fine particles. The results of evaluation of these Examples 1 to 7 and Comparative Examples 1 to 3 are shown in Table 2.

TABLE 2

| | drum wrap evaluation | | | paper transport | |
|---|---|---|---|---|---|
| Ex. Nos. | HINIP-HS paper | 5 piled sheets of cut paper | 8 piled sheets of cut paper | performance (using HINIP-HS paper) | image quality |
| 1 | not produced | not produced | not produced | superior | superior |
| 2 | not produced | not produced | not produced | superior | superior |
| 3 | not produced | not produced | not produced | superior | superior |

TABLE 2-continued

| | drum wrap evaluation | | | paper transport | |
|---|---|---|---|---|---|
| Ex. Nos. | HINIP-HS paper | 5 piled sheets of cut paper | 8 piled sheets of cut paper | performance (using HINIP-HS paper) | image quality |
| 4 | not produced | not produced | not produced | superior | superior |
| 5 | not produced | not produced | not produced | superior | superior |
| 6 | not produced | not produced | not produced | superior | superior |

TABLE 2-continued

| Ex. Nos. | drum wrap evaluation HINIP-HS paper | 5 piled sheets of cut paper | 8 piled sheets of cut paper | paper transport performance (using HINIP-HS paper) | image quality |
|---|---|---|---|---|---|
| 7 | not produced | not produced | not produced | superior | superior |
| Comp. 1 | produced in 2 to 5 of 50 sheets at initial stage | produced in 3 or 4 of 5 sheets | produced in all of 8 sheets | meandering in 2 or 3 of 100 sheets | image disorder was produced in 2 or 3 of 100 sheets |
| Comp. 2 | produced in 1 or 2 of 100 sheets at initial stage | produced in 1 or 2 of 5 sheets | produced in all of 8 sheets | comparatively superior | slight image disorder was produced |
| Comp. 3 | often produced at initial stage | produced in 5 of 5 sheets | produced in all of 8 sheets | meandering in 10 of 100 sheets | character disorder and transfer missing were produced |

As is understood from Table 2, when the transfer belt surface is coated with a solution containing at least one kind of fine particles such as silica, silicone, etc. dispersed in a solvent, and at least one kind of organic compound dissolved in the solvent, no-drum wrap is produced, paper transport performance is superior in stability, and image quality is superior. In Example 1, it is found that problems such as drum wrap, image disorder, and so on did not occur in the test of continuous printing of 100 thousand pages, and stability was kept for a long time.

As described above, according to the present invention, fine particles having more superior releasability than the surface of a transfer belt are dispersed in a solvent, mixed with organic material soluble in the solvent, and then sprayed on the surface of the transfer belt by means of a spray or the like. In such a manner, a layer having fine roughness with superior releasability is formed on the surface of the transfer belt. Therefore, wrapping of paper on a photoconductor (drum wrap) can be eliminated, so that not only it is possible to obtain superior paper transport performance and paper releasability, but also it is possible to obtain superior images stably. Particularly, in comparison with a conventional transfer belt, superior resistance against drum wrap is kept for a long time. Accordingly, it is possible to improve the reliability of the apparatus as a whole, and it is possible to obtain superior images.

While the invention has been described in detail and with reference to specific examples thereof, it will be apparent to one skilled in the art that various changes and modifications can be made therein without departing from the spirit and scope thereof.

What is claimed is:

1. A transfer belt for use in an electrophotographic apparatus for transporting an image support onto which a toner image formed on the surface of a photoconductor comprising a photoconductive layer is transferred, which transfer belt comprises a base layer having thereon a surface layer formed from a coating liquid comprising:

a solvent;

at least one kind of inorganic or organic fine particles dispersible in the solvent; and at least one kind of organic compound soluble in the solvent;

wherein a total coating amount of fine particles and organic compound is from 0.3 g to 20 g per 1000 $cm^2$.

2. The transfer belt according to claim 1, wherein said fine particles are electrically insulating material.

3. The transfer belt according to claim 1, wherein said inorganic fine particles are silica particles, and said organic fine particles dispersible in the solvent are particles of a silicone material.

4. The transfer belt according to claim 1, wherein said solvent is an organic solvent.

5. The transfer belt according to claim 1, wherein said base layer is an elastic layer, said elastic layer comprising a plurality of layers.

6. The transfer belt according to claim 1, wherein said base layer is a fluorine-containing elastic layer.

7. The transfer belt according to claim 3, wherein said silica fine particles have the same electrification polarity as a voltage applied to said transfer belt.

8. The transfer belt according to claim 1, wherein said organic compound soluble in the solvent is a silicone material.

9. An electrophotographic apparatus comprising:

a photoconductor comprising a photoconductive layer onto which a toner image is formed; and a transfer belt for transporting an image support onto which said toner image formed on the photoconductor is transferred, wherein said transfer belt comprises a surface layer formed from a coating liquid comprising:

a solvent;

at least one kind of inorganic or organic fine particles dispersible in the solvent; and at least one kind of organic compound soluble in the solvent;

wherein a total coating amount of fine particles and organic compound is from 0.3 g to 20 g per 1000 $cm^2$.

* * * * *